United States Patent [19]

Weihrauch

[11] Patent Number: 4,958,402

[45] Date of Patent: Sep. 25, 1990

[54] BRISTLE ARTICLE

[75] Inventor: Georg Weihrauch, Wald-Michelbach, Fed. Rep. of Germany

[73] Assignee: Coronet-Werke Heinrich Schlerf GmbH, Wald-Michelbach, Fed. Rep. of Germany

[21] Appl. No.: 195,794

[22] Filed: May 19, 1988

[30] Foreign Application Priority Data

May 23, 1987 [DE] Fed. Rep. of Germany ..... 3717475

[51] Int. Cl.[5] ..... A46B 3/00; A46B 15/00

[52] U.S. Cl. ..... 15/159 A; 15/160; 15/167.1; 15/186; 15/187; 300/21

[58] Field of Search ..... 15/186, 187, 188, 159 A, 15/206, 167.1, 167.2, 190, 191 R, 192, 195, DIG. 6, 160; 132/218, 329; 300/21

[56] References Cited

U.S. PATENT DOCUMENTS

| | | | |
|---|---|---|---|
| 1,663,778 | 3/1928 | Seeger | 15/206 X |
| 2,627,621 | 2/1953 | Bardugon | 15/206 |
| 3,325,845 | 6/1967 | Sawkiw | 15/167.1 |
| 3,698,405 | 10/1972 | Walker | 15/159 A |
| 3,878,580 | 4/1975 | Stohr et al. | 15/159 A |
| 4,161,050 | 7/1979 | Sasaki et al. | 15/159 A |
| 4,486,915 | 12/1984 | Stewart et al. | 15/159 A |
| 4,527,575 | 7/1985 | Vasas | 132/218 |
| 4,687,257 | 8/1987 | Stern | 15/167.1 |

*Primary Examiner*—Edward L. Roberts

*Attorney, Agent, or Firm*—Antonelli, Terry, Stout & Kraus

[57] ABSTRACT

Bristle articles comprise a bristle carrier and bristles mechanically or thermally fixed thereto and formed from plastic monofilaments, optionally combined into bundles. For increasing the cleaning, distributing or application function of such bristle articles, over at least part of their length the monofilaments are flocked with short plastic fibres. Such bristle articles can be produced in that the surface of the monofilaments is provided with an adhesive or the surface thereof is heated to the soft plastic state and subsequently the fibres are applied to the monofilament in an electrostatic field. Instead of this, it is also possible to subsequently apply the fibres to the bristles connected to the bristle carrier, e.g. by means of an adhesive.

32 Claims, 3 Drawing Sheets

BRISTLE ARTICLE

BACKGROUND OF THE INVENTION

The present invention relates to a bristle article comprising a handle or a holder and at least one bristle formed from a stretched and optionally thermally stabilized plastic monofilament, as well as to a process for the production thereof.

Bristle articles within the meaning of the invention are all appliances or products comprising at least one bristle with a holding or engaging possibility for the hand or a holder or individual bristles or bristles combined into bundles on a carrier. Examples thereof are brushes of all types (flat, rod-shaped, cylindrical), brooms, paint brushes, bristle pads, etc. It is now standard practice to use for such appliances synthetic bristles, which are obtained from plastics of different types by extruding monofilaments. In order to give the monofilaments characteristics similar to those of natural bristles, which are characterized by flexibility and a long-lasting re-righting capacity, following extrusion, the monofilaments are stretched in order to orient the molecular chains in the axial direction and are subsequently stabilized by heat treatment, with the orientation of the molecular chains being virtually frozen in. These monofilaments are then individually or combined in bundles cut to length and fixed to the bristle carrier. Hitherto such fixing has taken place in a largely mechanical manner, in that the bristle carrier is provided with holes in which the bristles or bristle bundles are inserted and are mechanically fixed, e.g. by means of anchor wires, adhesives or the like. Of late the thermoplastic characteristics of the bristles and/or the bristle carrier have been utilized, in that the bristles are welded to the carrier or are inserted in the soft plastic material of the carrier, or are inbedded therein during the injection moulding or expanding of the carrier.

It is also known (DE-B-1 235 856) to anchor the bristles on the bristle carrier, providing the latter with an adhesive and applying the bristles in the electrostatic field. This process is performed in similar manner to the flocking of materials. Bristle articles produced in this way are only suitable for a few functions as a result of the relatively tangled and disordered arrangement of the bristles, which must also be very short and thin. It is also known in connection with an eyelash brush to provide the bristle carrier with certain areas with bristles and to flock same with fibers in the intermediate areas (DE-A-32 31 574, DE-A-34 34 405). It is finally known in connection with hair brushes with injection moulded pins (DE-C-33 17 143) to flock the pins or pin carriers with fibers.

All the aforementioned bristle articles suffer from the disadvantage that, as a result of the construction of the bristles as monofilaments with a smooth surface, they are unable to function in a completely satisfactory manner. If the greatest importance is attached to the cleaning action, the latter is essentially limited to a stripping off or bringing together of the dirt particles by the chafing or pushing bristle ends, which engage with the surface to be cleaned over a short length. This applies with respect to cleaning brushes of all types, such as clothes brushes, tooth brushes, as well as brooms and the like. If the greatest importance is attached to the application or engagement, e.g. application of water to the surface to be cleaned by means of a scrubber, a wet mop, or the like, the application of paints by a paintbrush, the application of cosmetics or the like, as well as hair dyes, etc. in the cosmetic field, then the bristles of the appliances used are designed in such a way that the appliance has a maximum retention capacity for the substance to be applied, which as a rule is brought about by a correspondingly dense bristle coverage. It is also known for this purpose to make use of pitted, grained, corrugated or cross-sectionally profiled bristles.

The aim underlying the present invention resides in providing a construction for bristle articles, which leads to an improvement of each of the aforementioned functions, namely cleaning, application, distribution, etc.

In the case of the aforementioned bristle articles, this aim is realized in that over at least part of its length the bristle is coated with short projecting fibers.

In the simplest case this basic principle provides an appliance or implement having only one bristle, which forms a thin, flexible core with a good righting capacity and has a handle or holder, as well as a coating of projecting fibers surrounding the same outside the handle. Such a fiber-coated bristle can e.g. be used for interdental cleaning in much the same way as a tooth pick or eyelash brush, but several thereof can also be fixed to a holder or carrier.

If e.g. the bristle article comprises a bristle carrier and a plurality of plastic bristles connected thereto, then the invention gives a bristle article, in which the bristles over at least part of the length thereof are coated with short projecting plastic fibers.

It is not important how the bristles are joined to the carrier. For example and as is known per se, the bristles can be moulded in one piece or integrally with the carrier or part thereof. In this case the fiber coating is only applied after the production of the injection moulded part.

However, if as usually the case, the bristle article comprises a bristle carrier and bristles fixed thereto mechanically or thermally and constituted by stretched and optionally thermally stabilized plastic monofilaments, which are optionally combined into bundles, then according to the invention the bristles are coated over part of their length with short projecting plastic fibers.

As a result of the inventive construction in all the aforementioned fundamental variants a bristle is obtained, which is constituted by a core and external flocking. The monofilament forming the core has all the favorable characteristics of a conventional bristle, with regards to the flexibility and the re-righting capacity, while the flocking of short fibers with a much smaller diameter than the monofilament gives the bristle a crusty-rough surface. In the case of the cleaning function, this has the advantageous consequence that the stable bristle core makes it possible to exert the necessary pressure on the surface to be cleaned, while the large number of fibres brings together the dirt particles and also in part stores the particles between them, so that even very fine dirt particles can be taken up. If the main function is the application of a substance, then the fibrous surface structure gives the individual bristle a storage capacity and therefore the brush, paintbrush, mop, etc. a much greater storage capacity, no matter whether fluid or pulverulent substances are involved, which have to be applied or engaged. In this case it is a further characteristic of the application or the like that it can take place much more uniformly than with conventional bristles. However, if the care function is the most important, such as is e.g. the case with hair brushes, hair dye brushes, etc, then the stable or flexible core ensures the necessary dividing up and distribution of the hair, whereas the fine fibers fulfill a care and dyeing function with respect to the individual hairs. Much the same occurs with massage brushes, in which the bristle core performs the vigorous massage action, whereas the fine fibers assists the rubbing function.

The storage capacity of the inventively constructed bristle articles is comprable with that of textile cloths, nonwovens or sponges, without suffering from the hygienic disadvantages thereof, because the freestanding bristles and fibers dry more rapidly and completely.

It is admittedly known from textile technology to flock yarns with fibers. However, yarns are not stable monofilaments and instead constitute an unstable structure formed from a plurality of thinner fibers. The exclusive function of flocking in this case is to give the finished textile product a soft surface and a certain filling effect and velour-like structure. The objective is completely different in the present case.

According to an advantageous construction the fibers are arranged substantially radially on the monofilament, which has a particularly favorable influence on the cleaning and application function.

The monofilament and the fibers can be made from the same or different plastic. In the latter case the fibres are mainly fixed to the monofilament by adhesion, whereas, in the former case they can be imbedded or welded into the monofilament by melting of the monofilament surface and subsequent solidification.

As a result of the inventive flocking of the monofilaments in many applications less bristles per surface unit will be required than in the case of conventional bristle articles. In individual cases it may be adequate if, within a bristle bundle, only individual monofilaments are flocked or if within a bristle coverage of an appliance only individual monofilaments or the monofilaments of some of many bristle bundles are flocked. In this way it is also possible to produce multi functional bristle articles, which, for example, in one area have conventional bristles and in another area flocked bristles.

Finally, an inventively constructed bristle articles can be characterized in that the individual monofilaments are shaped at their ends to form a spherical head by melting the monofilament and the fibers. This construction is, for example, advantageous in the case of hair brushes, where the spherical heads facilitate the penetration into the hair and also lead to no unpleasant reactions, even in the case of sensitive sculp.

Another embodiment of the invention is characterized in that the bristles cut to length and flocked are fixed by their free ends, accompanied by the formation of a camber, to the bristle carrier. This construction has the advantage that the advantageous effects of flocking are also obtained at the bent over bristle ends.

According to a further modification the bristle flocking is cut to a desired outer contour, so that e.g. conical individual or multiple bristles with flocking are obtained.

It is also possible to zonely eliminate the flocking of the bristle by embossing or stamping, in order to obtain fiber-free bristles, which, for example, in the case of a single bristle form a handle or can be shaped to such.

The invention is also directed at a process for producing the aforementioned bristle articles. If the latter in the simplest case comprises a handle or a holder and at least one bristle, then according to the invention the bristle or the endless monofilament from which the bristle is obtained by cutting to length, is coated on its surface, at least zonely with short projecting plastic fibers. It is also possible for the bristle or the endless monofilament from which the bristle is obtained by cutting to length to be coated over its entire length with short projecting plastic fibers and under the action of heat, e.g. by stamping, the fiber coating can be remelted to the core-forming bristle, accompanied by the formation of the handle.

If e.g. in an initially conventional manner plastic monofilaments stabilized by stretching and optionally heat treatment and optionally combined into bundles are fixed to a bristle carrier by mechanical insertion, injection moulding or expansion or by melting the bristle carrier surface and/or the ends of the monofilaments, then according to the invention the surface of said monofilaments is coated with short plastic fibers.

The coating of the monofilaments can take place in that they are provided on the surface with an adhesive and subsequently coated with the fibers. Instead of this and in the case of a corresponding affinity of the material pair constituted by the monofilament and the fibers, it is also possible to heat the surface of the monofilaments to a soft plastic state and then to coat same with the fibres. Instead of this, immediately after the extrusion of the monofilament, the fibres can be applied to the latter.

In the former case the monofilaments are preferably passed through an adhesive bath or mist and are then flocked with fibers, whereas in the latter case the monofilaments are passed through a heating zone and coated therein or behind it with the fibres. Then, as also after the extrusion of the monofilaments, the production of the fiber-coated bristles with the endless monofilaments can take place in a continuous process.

Preferably the coating by flocking takes place in an electrostatic field, independently of the manner of fixing the fibers to the monofilament.

The coated filament can be brought to a particular contour matched to the intended use by subsequent cutting of the fibers, by zonal hot stamping or embossing, or by melting its free end.

BRIEF DESCRIPTION OF THE DRAWINGS

Further details and advantages of the invention can be gathered from the embodiments described hereinafter and the attached drawings, wherein:

FIG. 4 is a cross-sectional view corresponding to FIG. 3 of another embodiment of a brush or the like;

FIG. 5 is a cross-sectional view third embodiement of a brush or the like;

FIG. 6 is a cross-sectional view of another embodiment of a brush or the like;

DETAILED DESCRIPTION

Figure 1:
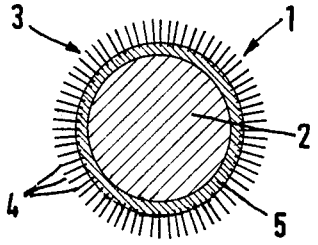
FIG. 1 is a cross-sectional view through an individual bristle in a first embodiment.

For reasons of simplicity and to make it easier to understand, all the drawings only show a single bristle 1. The arrangement of several bristles, such as also the combination thereof to bundles and other details concerning a bristle coverage for a cleaning or applicator means can take place in conventional manner, so that there is no need to show this in the drawings.

A single bristle 1 comprises a monofilament core 2, which is obtained through extrusion and subsequent stretching, as well as stabilization, and a coating or flocking 3 of a plurality of short, thin fibers 4. The monofilament core 2 and the fibers 4 are both made from plastic. The coating 3 of fibers 4 can, as shown in FIG. 1, be fixed by means of an adhesive coating 5, which is applied to the monofilament core 2. Coating preferably takes place in the electro-static field, which ensures a corresponding orientation of the fibers 4 during or after meeting the adhesive coating 5. This ensures that the fibers 4 project approximately radially from the monofilament core 2.

Figure 2:
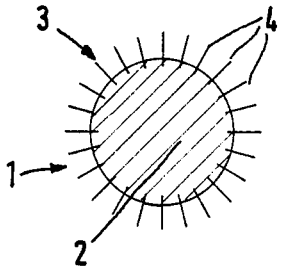
FIG. 2 is a cross-sectional view corresponding to FIG. 1 of another embodiment of a single bristle.

In FIG. 2, the coating 3 of the fibers 4 is positively connected to the monofilament core 2, in that e.g. the surface of the monofilament core 2 is brought into a soft plastic state and the fibers 4 penetrate the soft plastic layer and are fixed after solidification.

Figure 3:
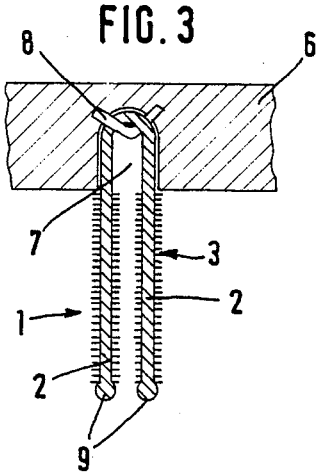
FIG. 3 is a partial cross-sectional view through a brush or the like with mechanical fixing of the bristles.

FIG. 3 is a detail of an appliance with a bristle carrier 6, which can be made from a random material. Bristles 1, optionally in bundles, are fixed to the bristle carrier 6 in that, accompanied by the formation of a loop, they are pushed or slid into a hole 7 in the bristle carrier and are fixed by a clip 8 mechanically driven into the bristle carrier. The monofilament core 2 bent into a double layer is, in this embodiment, provided in its area located outside the bristle carrier 6 with coating 3. In addition, the free ends of the monofilament core 2 are shaped to form a spherical thickened part 9, e.g. by melting, the fibers forming the flocking or coating 3 optionally also being melted.

Figure 4:
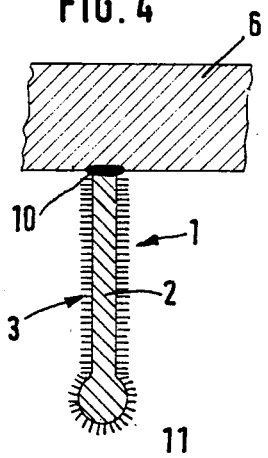

In the embodiment according to FIG. 4, the bristles 1 with their monofilament core 2 are welded at 10 to the bristle carrier 6, in that the fixing-side end thereof is melted, as also occurs at bristle carrier 6. In this embodiment the flocking 3 also extends over the spherical, thickened end 11 of the monofilament core 2. In this case the flocking 3 is subsequently applied to the shaped bristle core 2.

Figure 5:
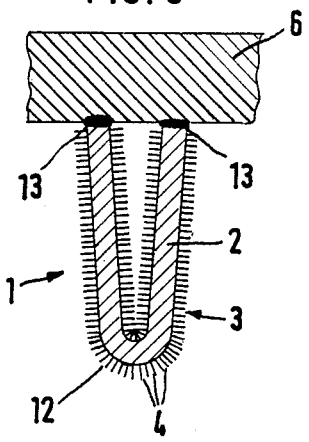

FIG. 5 shows an embodiment in which the monofilament core 2 with its flocking 3 is looped, accompanied by the formation of a camber 12 and its free ends 13 are again welded to the bristle carrier 6. It is clear that in this construction the fibers 4 of flocking 3, which can be applied to the endless monofilament is also present in the vicinity of camber 12 and can consequently also exert its action there.

Figure 6:
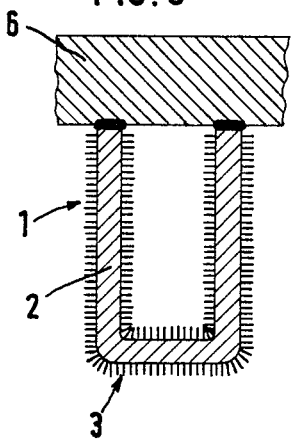

FIG. 6 shows a variant, in which the monofilament core 2, which is once again provided with a flocking 3 over its entire length, is bent in U-shaped manner and is once again fixed by its free ends to the bristle carrier 6.

Figure 7:
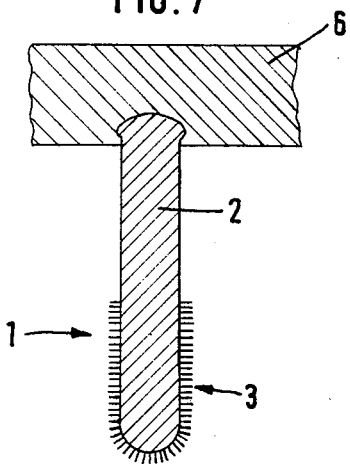
FIG. 7 is a partial cross-sectional view corresponding to the aforementioned representations through a type of bristle comb.

FIG. 7 shows a detail from a comb-like appliance with a bristle carrier 6 to which the bristles 1 are fixed by welding or thermal insertion. Monofilament core 2 has an above-average, large diameter, in order to give it a high bending strength. Core 2 is provided zonely, namely on the outer half of its length with the flocking 3, which is advantageously applied after fixing the monofilament core 2 to the bristle carrier 6.

Figure 8:
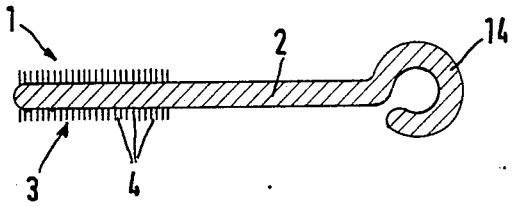
FIG. 8 is a cross-sectional view an individual bristle with flocking and handle.

FIG. 8 shows a single bristle 1, whose monofilament core 2, which once again has an increased bending stability, is provided over part of its length with fiber flocking 3. Core 2 is also constructed at its end opposite to the flocking 3 with a handle 14 in the form of a type of ring. Such an appliance in the case of a corresponding stability of core 2 can e.g. be used for cleaning interdental spaces.

Figure 9:
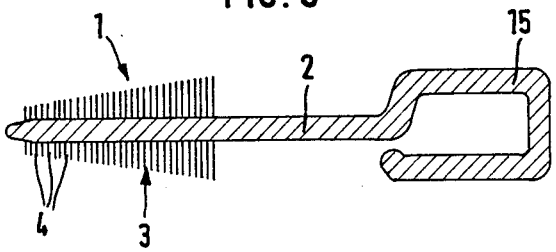
FIG. 9 is a cross-sectional view of another embodiment of an individual bristle with flocking and handle.

In the embodiment according to FIG. 9 an eyelash or mascara brush is involved in the form of a single bristle 1, whose monofilament core 2 is shaped to a handle 15 and which is provided at its free end with a flocking 3 of fibers 4. This flocking is conically cut to size, which can take place following application to the monofilament core.

The flocking-free area of an individual bristle 1, e.g. handle 14, 15 with the immediately following part of the monofilament core 2, can also be obtained in that a monofilament flocked over its entire length is shaped in this area by hot stamping or embossing, the fibers 4 of the flocking being melted and coalesce with the monofilament core 2 and therefore give same a larger cross-section compared with the original state of the monofilament core.

I claim:

1. Bristle article comprising holder means, at least one thermally stabilized stretched plastic monofilament bristle, and flocked short projecting fibers adhesively coated to at least a portion of an axial length of the at least one thermally stabilized stretched plastic monofilament bristle.

2. Bristle article comprising bristle carrier means, a plurality of plastic bristles connected to said bristle carrier means, and flocked short projecting fibers adhesively coated to at least a portion of an axial length of each of said plurality of plastic bristles.

3. Bristle article according to claim 2, wherein said to form bundles of bristles.

4. Bristle article according to claim 3, wherein the bristles are cut to length and fixed at free ends thereof to the bristle carrier means, accompanied by a formation of a camber.

5. Bristle article according to claim 4, wherein the flocked bristles are subsequently cut to a desired outer contour.

6. Bristle article according to claim 3, wherein the bristles are mechanically fixed to the bristle carrier means.

7. Bristle article according to claim 3, wherein the bristles are thermally fixed to the bristle carrier means.

8. A bristle article comprising bristle carrier means, a plurality of plastic bristles connected to said bristle carrier means, and short projecting fibers coating at least a portion of an axial length of each of said plurality of plastic bristles, and wherein the bristles are coated by flocking.

9. Bristle article according to claim 8, wherein the fibers on the bristles are substantially radially arranged.

10. Bristle article according to claim 9, wherein the bristles and the short projecting fibers are made from the same plastic material.

11. Bristle article according to claim 9, wherein the bristles and the short projecting fibers are made from different plastic materials.

12. Bristle article according to claim 8, wherein the short projecting plastic fibers are adhesively coated on the bristle.

13. Bristle article according to claim 8, wherein the short projecting plastic fibers are coated and embedded on the bristle by melting a surface of the bristles and subsequent solidification.

14. Bristle article comprising holder means, at least one thermally stabilized stretched plastic monofilament bristle, and short projecting fibers coating at least a portion of an axial length of the at least one thermally stabilized stretched plastic monofilament bristle, and wherein the at least one thermally stabilized stretch plastic monofilament bristle is shaped at one end thereof with a spherical head by melting the at least one thermally stabilized stretched plastic monofilament bristle and at least some of the short projecting fibers.

15. A bristle article comprising bristle carrier means, a plurality of bristles fixed to said bristle carrier means and combined to form bundles of bristles, and short projecting plastic fibers coating at least a portion of an axial length of each of the bristles of the bundles of bristles, wherein the bristles are coated by flocking.

16. A bristle article according to claim 15, wherein the fibers on the bristles are substantially radially arranged.

17. Bristle article according to claim 16, wherein the bristles and the short projecting fibers are made from the same plastic material.

18. Bristle article according to claim 16, wherein the bristles and the short projecting fibers are made from different plastic materials.

19. Bristle article according to claim 15, wherein the short projecting plastic fibers are adhesively coated on the bristles.

20. Bristle according to claim 15, wherein the short projecting plastic fibers are coated and embedded on the bristles by melting a surface of the bristles and subsequent solidification.

21. Bristle according to claim 20, wherein the fibers on the bristles are substantially radially arranged.

22. Bristle according to claim 15, wherein the bristles are mechanically fixed to the bristle carrier means.

23. Bristle according to claim 22, wherein the bristles and the short projecting fibers are made from the same plastic materials.

24. Bristle according to claim 22, wherein the bristles and the short projecting fibers are made from different plastic materials.

25. Bristle article according to claim 15, wherein the short projecting plastic fibers are adhesively coated on the bristles.

26. Bristle article according to claim 15, wherein the short projecting plastic fibers are coated and embedded on the bristle by melting a surface of the bristles and subsequent solidification.

27. Bristle article according to claim 26, wherein the short projecting plastic fibers are adhesively coated on the bristles.

28. Bristle article according to claim 26, wherein the short projecting plastic fibers are coated and embedded on the bristle by melting a surface of the bristles and subsequent solidification.

29. Bristle article according to claim 15, wherein the bristles are thermally fixed to the bristle carrier means.

30. Bristle article according to claim 29, wherein the fibers on the bristles are substantially radially arranged.

31. Bristle according to claim 30, wherein the bristles and the short projecting fibers are made from different plastic materials.

32. Bristle article according to claim 29, wherein the bristles and the short projecting fibers are made from the same plastic material.

* * * * *